United States Patent [19]

Novinski et al.

[11] Patent Number: 4,955,481

[45] Date of Patent: Sep. 11, 1990

[54] TABLET PACKAGE HAVING ALTERNATIVE INDICATORS AND METHOD OF USE

[75] Inventors: Michael V. Novinski; Thomas J. Patton, both of West Chester, Pa.

[73] Assignee: American Home Products Corp., New York, N.Y.

[21] Appl. No.: 882,128

[22] Filed: Jul. 3, 1986

[30] Foreign Application Priority Data

Jul. 25, 1985 [GB] United Kingdom ..... 8518828

[51] Int. Cl.[5] ..... B65D 83/04; B42D 15/00

[52] U.S. Cl. ..... 206/534; 206/459; 206/472; 283/81; 283/102

[58] Field of Search ..... 206/530, 531, 532, 534, 206/538, 472, 473, 459; 283/72, 102, 100, 81

[56] References Cited

U.S. PATENT DOCUMENTS

| | | | |
|---|---|---|---|
| 2,780,353 | 2/1957 | Volckening | 206/539 |
| 3,055,117 | 9/1962 | Bernstein et al. | 283/102 |
| 3,194,232 | 2/1970 | Dubbels | 206/459 |
| 3,387,699 | 6/1968 | Heller | 206/539 |
| 4,120,399 | 10/1978 | Clarke | 206/474 |
| 4,123,125 | 10/1978 | Andry, III | 206/459 |
| 4,241,943 | 12/1980 | Malilovitz | 283/102 |
| 4,254,871 | 3/1981 | Poore | 206/459 |
| 4,389,963 | 6/1983 | Pearson | 206/459 |
| 4,524,869 | 6/1985 | Nader | 206/533 |
| 4,634,149 | 1/1987 | Donovan | 283/102 |
| 4,752,087 | 6/1988 | Weisbach | 283/102 X |

FOREIGN PATENT DOCUMENTS

| | | |
|---|---|---|
| 2929185 | 2/1981 | Fed. Rep. of Germany . |
| 1086653 | 10/1967 | United Kingdom . |
| 1236675 | 6/1971 | United Kingdom . |
| 1301501 | 12/1972 | United Kingdom . |
| 1208720 | 10/1979 | United Kingdom . |
| 2085308 | 4/1982 | United Kingdom . |
| 2148795 | 6/1985 | United Kingdom . |

OTHER PUBLICATIONS

Photocopy of "Brevinor" (Syntex) Contraceptive Folder Pack; undated, but Prior Use in United Kingdom.

Photocopy of "Ortho-Novin 1/50" (Ortho Pharmaceutical Ltd.) Contraceptive Folder Pack Undated, but Prior Use in United Kingdom.

Photocopy of "NORINYL-1" (Syntex) Contraceptive Folder Pack; Undated but Prior Use in United Kingdom.

Photocopy of "NORINYL-1" (Syntex) Contraceptive Folder Pack; Undated but Prior Use in United Kingdom.

Photocopy of "OVYSMEN" (Ortho Pharmaceutical Ltd.) Contraceptive Folder Pack; Undated, but Prior Use in United Kingdom.

*Primary Examiner*—Bryon P. Gehman

*Attorney, Agent, or Firm*—Arthur G. Seifert

[57] ABSTRACT

Packaging for a course of tablets comprises a base for a blister pack and a cover flap. Rub-off indicators are provided on the inner surface of the flap to permit indication of one of a range of alternatives related to the course. The indicators may be color keyed to particular doses of the course. A method of using such a pack is also disclosed.

15 Claims, 2 Drawing Sheets

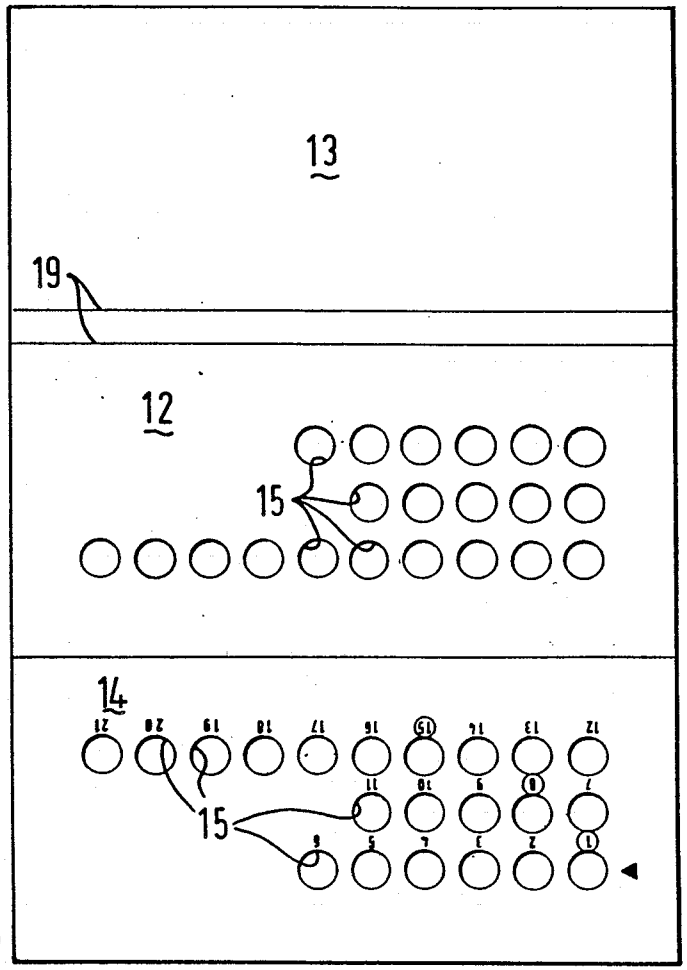
FIG.2
FIG.3
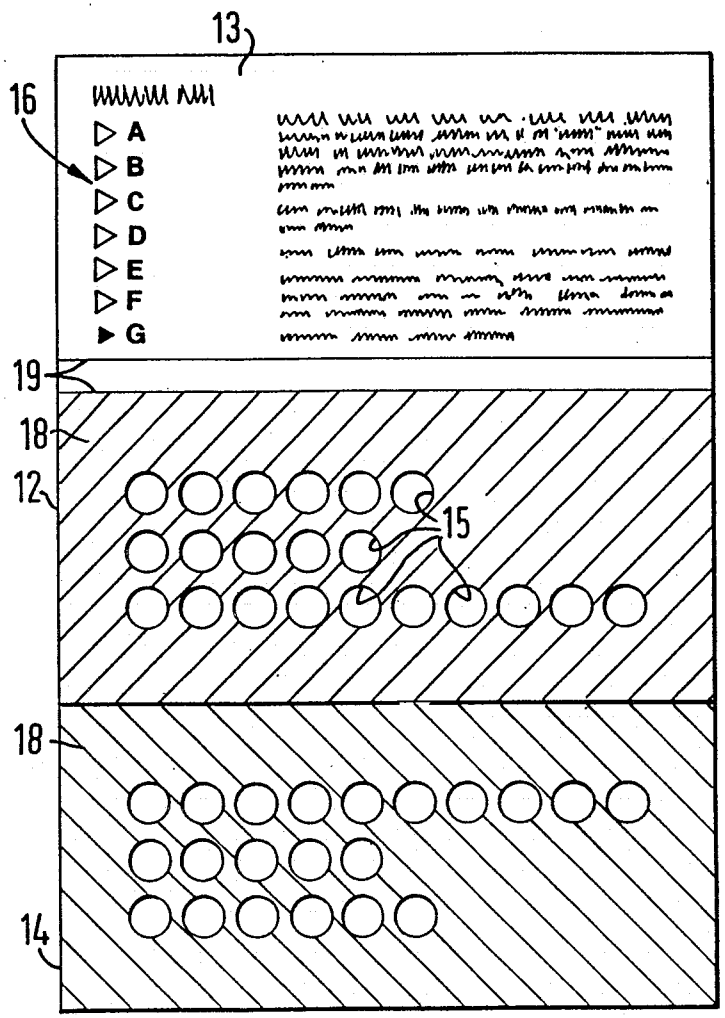

TABLET PACKAGE HAVING ALTERNATIVE INDICATORS AND METHOD OF USE

This invention relates to a package for pharmaceutical tablets and in particular to a package suitable for tablets to be taken in an ordered sequence. The invention also relates to a method of using the package.

Tablets are a convenient means of administering a course of treatments to a patient. Frequently tablets containing different ingredients or of different strengths must be taken in a particular order dictated by the course. For example a course of contraceptive tablets may comprise two or three different types of tablet to be taken sequentially for each menstrual cycle; the tablets must be taken in the correct order to ensure that the course has the best chance of success.

Much thought has been given to the design of packages suitable for tablets to be taken in an ordered sequence and particularly to ensure maximum patient compliance in taking the correct dosage at the prescribed time.

Packaging must fulfill a number of conflicting requirements. It must provide adequate protection for the tablets but be convenient to use, tablets must be securely retained and yet be easily accessible, instructions and directions for use must be concise and unambiguous. The package must also be attractive to look at and to use. These factors, and others, are important in devising a package which fulfills the functional requirements and yet gives maximum patient compliance.

Oral contraception by a course of tablets taken sequentially is probably the most common case in which the difficulty of ensuring patient compliance is encountered. Tablets are normally contained in blister packs and the patient ejects each tablet through the foil base by pressing the appropriate blister. Such packs are extremely well known and have the advantage of an individual sterile environment for each tablet together with adequate mechanical strength and cheapness of manufacture. Blister packs have certain disadvantages however, for example the necessary printing which is on the reverse side to the blisters, is often indistinct and is in any event usually lost as each successive tablet is ejected. The mechanical strength of the blister pack is adequate for housing the tablets but may not provide sufficient protection where the blister pack is, for example, kept in a womans handbag along with items such as combs, nail files, scissors etc.

For these reasons it is most common to pack contraceptive blister packs in a cardboard box along with an instruction leaflet. Frequently three blister packs, 3 months supply, are provided in each box.

Boxes provide protection for the blister packs and give additional space for instructions and other printed information. Normally however instructions for use and other information is given on a separate leaflet enclosed in the box with the blister packs. Boxes are difficult to load with blister packs and become shabby and decrepit after several weeks supply of contraceptive pills have been taken. The practice of providing several blister packs in each box can also confuse the user. The box may fall apart and the instruction leaflet may be lost as a result.

So called biphasic and triphasic oral contraceptive courses, containing respectively two and three different types of contraceptive preparation have been found to be more acceptable to some women taking oral contraceptives. Biphasic and triphasic courses pose special problems of patient compliance however. Not only must the patient remember or be guided to take the tablets in the correct sequence at daily intervals, she must also remember to make a note of the day on which the course was started. This is because the course is preferably started on a specific day in the menstrual cycle to maximise effectiveness, and since the packaging must cater for women whose menstrual cycle may begin on any of the seven days of the week the individual blisters cannot be marked sequentially with the days of the week as is usual with a course of oral contraceptive tablets all of the same type; sequential tablets in a biphasic or triphasic course are therefore usually numbered in sequence and the woman must refer to her starting day and calculate which tablet is the next to be taken if she is for example unsure whether she has taken a tablet on a particular day.

One method of recording the starting day for biphasic and triphasic contraceptive courses is to provide seven small empty blisters successively marked with the days of the week. The user punches the foil of the appropriate blister with an implement, e.g. a pencil, to permanently mark the blister pack. This method can be awkward and difficult to use and the marked blister is often not easy to see; this does not facilitate maximum patient compliance.

Other methods of marking the start day on the blister pack have been proposed but none appears to have been wholly successful in use. The difficulty of marking the blister pack and generally of ensuring patient compliance has resulted in some doctors prescribing biphasic and triphasic contraceptive courses only to patients whom they percieve to be of above average intelligence.

The present invention overcomes the aforementioned disadvantages by providing a tablet package which is attractive, convenient to use, economical to manufacture and has features which increase the likelihood of good patient compliance.

According to the invention there is provided packaging for a course of tablets and comprising a folder having a base to incorporate a blister pack of tablets and a cover hinged to the base, a plurality of rub-off indicators being provided on the inner surface of said folder, each indicator being associated with one of a range of alternatives of the course.

In a preferred embodiment the range of alternatives comprises the seven days of the week and the rub-off indicators comprise a number of markers each covered by a removable layer of for example foil, metallised film or latex of a contrasting colour; such indicators are also known as scratch indicators.

In use the user selects the desired alternative and rubs the layer off the associated marker thereby giving a permanent indication that a particular alternative has been selected. The remainder of the rub-off indicators remain untouched. For a triphasic course of contraceptive tablets the user rubs off the layer associated with her particular starting day.

The invention also provides a method of indicating one of a range of alternatives in a course of pharmaceutical treatment, the method comprising the steps of providing packaging for the course of treatment, said packaging having thereon a range of alternatives and a rub-off indicator for each alternative; and rubbing off one only of said indicators to indicate a desired alternative. The untouched indicators serve the purpose of indicating to the user the days on which the course was not started. If more than one indicator is rubbed off or damaged this serves as a caution to the user each time the folder is opened for administration of a dose. Thus the indicators additionally provide passive reassurance to the user that the course is being taken satisfactorily and this as a further factor in ensuring patient compliance.

The rub-off indicator is on an interior part of the packaging. In a preferred embodiment the packaging comprises a folder having a base to incorporate the course and a hinged cover having the rub-off indicator on the inner side thereof.

A rub-off or scratch-off indicator can be provided on such a folder in an attractive and prominent way. In the preferred embodiment the indicator comes into view whenever the user opens the packaging to take medication. The rub-off indicator is easy to see and may be printed in contrasting colours, the user can mark the indicator without effort and needs no additional implement. In a preferred embodiment the user scratches the indicator with a finger nail. The factors of ease of use, visibility and presentation increase the chances of good patient compliance.

The use of a folder additionally provides space adjacent the rub-off indicator for dose instructions. The user is presented with the instructions each time the folder is opened to administer a dose.

The indicator may indicate the starting date of a course of medication. Such an indicator is valuable where the course is to last a specified period and the user may forget when the course was begun. In a preferred embodiment the indicator indicates the starting day of a course of biphasic or triphasic oral contraceptives. Other information relating to the course of medication may be selected from a list of variables, for example dosage strength, finishing date, best time for administering the course, e.g. before meals, etc.

The rub-off indicator preferably comprises a series of separate indicators, each associated with a particular day. In a preferred embodiment each indicator is in the shape of an arrow head of a first colour which may be rubbed-off to reveal a second easily distinguished colour. The second colour may be keyed to successive doses in the course of medication which are to be taken on the starting day and days following at regular intervals.

In a preferred embodiment the second colour is red, the starting day of the course and each seventh day thereafter having a red marker adjacent the medication to be taken on that day.

Each successive dose of the course may be numbered, successive numbers being of a colour readily distinguished from the colour keyed numbers provided for the first dose and each seventh dose thereafter.

The course of medication is preferably contained in a blister pack for reasons of security and sterility. The blister pack may be secured between hinged leaves forming the base of the folder previously described, apertures being provided in the leaves for the blisters and for ejection of the tablets. The invention further provides that such a blister pack be numbered adjacent successive blisters and that the starting day and each successive seventh day of the course be colour keyed to the rub-off indicator. This feature ensures that should the blister pack become detached from the folder, sufficient information is available to assist the user in continuing the course of medication.

In a preferred embodiment the blisters are arranged in three parallel rows, each row containing pills of a different type and colour. The blisters are in vertical register from the left-hand end as viewed; the rows may be of different length according to the number of pills of each type in the course. In one example the first row contains six pills of a first type, the second row five pills of a second type and the third row ten pills of a third type. A fourth row of seven placebo pills may be provided where continuous administration is desirable. The flush left sequencing of the rows of pills has been found to be a factor in improving patient compliance.

Other features of the invention will be apparent from the following description of a preferred embodiment shown by way of example only with reference to the accompanying drawings in which:

FIG. 2 is a plan view of one side of the folder shown in FIG. 1 prior to assembly;

FIG. 3 is a plan view of the other side of the folder of FIG. 2;

Figure 1:
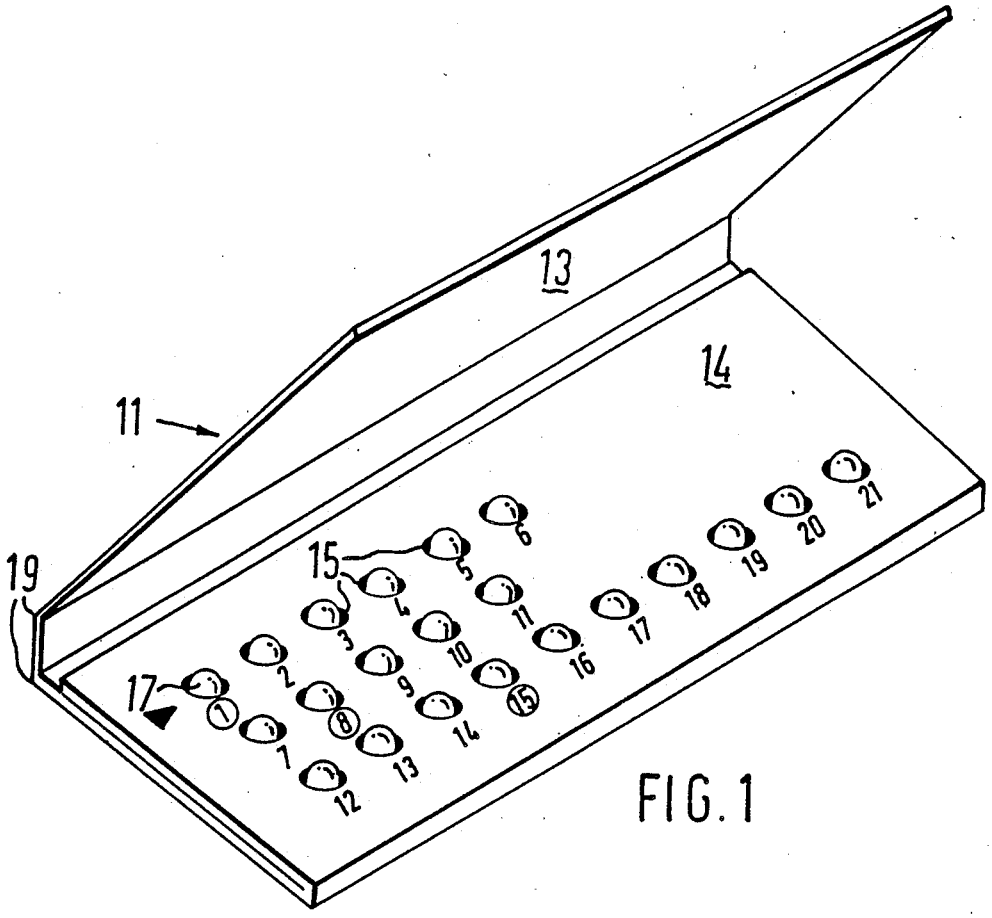
FIG. 1 is a perspective view of a folder according to the invention and incorporating a blister pack of tablets.

With reference to FIG. 1 there is shown a folder 1 for housing a blister pack of predetermined pattern. The folder 11 is formed from a single piece of card or paperboard and has a lid or cover flap to protect the blisters from damage.

With additional reference to FIGS. 2 and 3, the folder comprises a base 12 having a cover flap 13 and a securing flap 14. Apertures 15 are punched in the base 12 and flap 14 to register with blisters of a blister pack shown in FIGS. 4 and 5.

The inside face of the cover flap 13 includes a rub-off day indicator 16. The indicator comprises a series of arrow heads, one each adjacent a printed abbreviation of each day of the week. In the drawings each day of the week is represented by one of the letters A to G. The indicator 16 may be of a kind in which each arrow head is printed in a contrasting colour and covered by a removable layer of foil or metallised film or latex of another colour, usually silver. The user scratches off the foil layer with a finger nail to reveal the arrow head in contrasting colour and thereby provide a permanent indication of the relevant day. The arrow head adjacent day G is shown with the foil layer removed. The column of indicators may carry a beading for example 'START DAY'.

Other information, for example relating to dosage instructions, may be printed on the inside cover adjacent the indicator 16 for the users ready reference.

Figure 4:
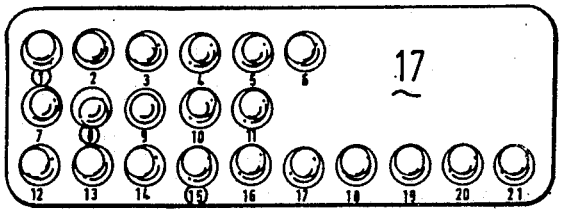
FIG. 4 is a plan view of one side of a blister pack suitable for use with the folder of FIGS. 2 and 3.
Figure 5:
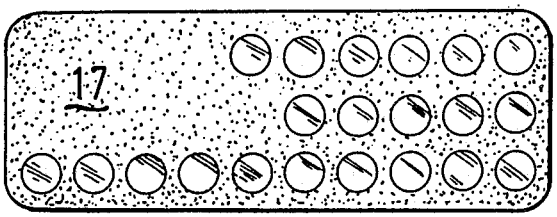
FIG. 5 is a plan view of the other side of the blister pack of FIG. 4.

The blister pack 17 illustrated in FIGS. 4 and 5 contains sufficient combined oral contraceptive tablets for a single menstrual cycle; each tablet is numbered sequentially as shown. Three different types of tablet are provided in a triphasic dose regime.

A first row of tablets, numbered 1 to 6, may contain ethinyloestradiol 30 mg and levonorgestrol 50 mg, a second row of tablets, numbered 7 to 11, may contain ethinyloestradiol 40 mg and levonorgestrol 75 mg and a third row of tablets, numbered 12 to 21 may contain ethinyloestradiol 30 mg and levonorgestrol 125 mg; each type of tablet is preferably of a different colour.

In use the blister pack 17 is placed on the base 12 and the securing flap 14 folded over to sandwich the blister pack.

Apertures for the individual blisters are provided, as shown, or alternatively a slot could be provided for each row of blisters.

Contact adhesive, indicated by cross hatching 18, may be provided on the base 12 and securing flap 14 to retain the blister in the folder. The blisters protrude through the respective apertures and a double fold, indicated at 19, is therefore provided between the base 12 and the cover flap 13 to allow the flap to fully close over the blisters.

The folder is numbered to correspond with the blister pack, each successive tablet in the course being numbered in the range 1 to 21. Numbers 1, 8 and 15 may be printed in a colour keyed to the contrasting colour of the appropriate arrow head, the other numbers are printed in a different colour; for example, the arrow head and numbers 1, 8 and 15 may be printed in red and the remaining numbers in black. Alternatively the numbers 1, 8 and 15 may be ringed in red as indicated in the drawing.

In this way the user has an indication of the starting day of each successive week of the course, as successive doses of the course are taken the user need only refer to the preceding red number to be certain of the day on which that dose should have been taken instead of having to refer to the first dose and counting the days therefrom. This feature is especially valuable for a course of treatment extending over several weeks.

In use the user rubs off the indicator relating to the starting day and takes the course of contraceptives one daily in numerical order.

Clearly where other courses of medication are contained in the folder the rub-off indicator can indicate other variable information which may be for the dispenser or the user to record.

The folder 11 provides protection for the blister pack whilst giving the user easy access and convenience of use. The folder provides ample space for information and instructions to be printed thereon and such instructions are always with the blister pack rather than being printed separately on a box or leaflet. The folder can be designed in an attractive and eye catching manner and the cover design can be easily changed without great cost. For contraceptive tablets only one months course is contained in each folder which increases the chance that the folder will remain smart and presentable. All of these factors make the folder attractive to use and further increase the chances of good patient compliance.

The invention has been described with reference to a course of tablets to be taken one daily. The tablet package of the invention is equally adaptable to a course where more than one tablet is to be taken at a particular time or where tablets are taken periodically at less or more than daily intervals.

The tablet folder may be manufactured of plastic or any other suitable material or alternatively may be made from separate pieces of sheet material joined by adhesive tape or the like. The rub-off indicator need not be in the shape of an arrow head, any suitable shape will suffice although the arrow head has the particular advantage of pointing to the relevant information. The information on the inner side of the cover may be preprinted on an adhesive label and attached either at the manufacturing stage or when the pack is dispensed. Such an arrangement has the advantage that prescribing information may be varied by the prescriber to suit different patients requirements.

Other alternatives are possible within the invention which is limited only by the scope of the accompanying claims.

What is claimed is:

1. Packaging for a course of pharmaceutical tablets and comprising a folder having a base to incorporate a blister pack of tablets and a cover hinged to the base, a plurality of rub-off indicators being provided on the inner surface of said folder each indicator being associated with one of a range of alternatives of the course.

2. Packaging according to claim 1, wherein the rub-off indicators are on the inner surface of said cover.

3. Packaging according to claim 1, wherein said indicators each comprise a marker of one colour covered by a rub-off foil layer of a contrasting colour.

4. Packaging according to claim 3, wherein the markers are the same colour.

5. Packaging according to claim 3, wherein the markers are colour keyed to the position of one or more tablets of the course.

6. Packaging according to claim 1, wherein the position of each tablet of the course is numbered sequentially for administration one daily, the range of alternatives being the days of the week, and the mark being colour keyed to the position of the first tablet of the course and every seventh tablet thereafter.

7. Packaging according to claim 6 and including a blister pack containing a triphasic course of contraceptive tablets, the tablets being arranged by type in three parallel rows, the first tablet of each row being in register in a line perpendicular to the rows.

8. Packaging for a course of pharmaceutical tablets comprising a folder having a base and a securing flap to incorporate a blister pack of tablets and, on the inner surface of said folder, seven rub-off indicators of the same colour, covered by a rub-off layer of a contrasting colour, each indicator marked to correspond to a day of the week, wherein the position of each tablet of the course is numbered sequentially for administration one daily and the rub-off mark is colour keyed to the position of the first tablet of the course and every seventh tablet thereafter.

9. Packaging according to claim 8 wherein the rub-off indicators are on the inner surface of said cover.

10. Packaging according to claim 9 and including a blister pack containing a triphasic course of contraceptive tablets, the tablets being arranged by type in three parallel rows, the first tablet of each row being in register in a line perpendicular to the rows.

11. A method of indicating one of a range of alternatives in a course of pharmaceutical treatment, the method comprising the steps of providing packaging for the course of treatment, said packaging having thereon a range of alternatives and a rub-off indicator for each alternative; and rubbing off one only of said indicators to indicate a desired alternative.

12. A method according to claim 11 wherein the packaging comprises a folder having a base and a securing flap to incorporate a blister-pack of tablets and a cover hinged to the base and further providing the rub-off indicators on the inner layer of said cover.

13. A method according to claim 12 further providing as said indicators a marker of one colour covered by a rub-off layer of a contrasting colour.

14. A method according to claim 13 further providing said markers of the same colour with said markers being colour keyed to the position of one or more tablets of the course.

15. A method according to claim 11 further providing sequential numbering at the position of each tablet and the range of alternatives corresponding to the days of the week and marks therefore which are colour keyed to the position of the first tablet of the course and every seventh tablet thereafter, for a course of daily administration.

* * * * *